US011280490B1

(12) United States Patent
Bottiger et al.

(10) Patent No.: US 11,280,490 B1
(45) **Date of Patent: *Mar. 22, 2022**

(54) COMBUSTION AEROSOL GENERATOR SYSTEM

(71) Applicant: Combat Capabilities Development Command, Chemical Biological Center, APG, MD (US)

(72) Inventors: Jerold R Bottiger, Aberdeen, MD (US); Jana S Kesavan, Catonsville, MD (US); Deborah R Schepers, Bel Air, MD (US)

(73) Assignee: The United States of America as Represented by The Secretary of the Army, Washington, DC (US)

( * ) Notice: Subject to any disclaimer, the term of this patent is extended or adjusted under 35 U.S.C. 154(b) by 223 days.

This patent is subject to a terminal disclaimer.

(21) Appl. No.: 16/743,261

(22) Filed: Jan. 15, 2020

Related U.S. Application Data

(62) Division of application No. 14/835,199, filed on Aug. 25, 2015, now Pat. No. 10,539,320.

(51) Int. Cl.
*F22B 1/28* (2006.01)

(52) U.S. Cl.
CPC ..... *F22B 1/288* (2013.01)

(58) Field of Classification Search
CPC .... F22B 1/288; A61M 11/005; A61M 11/007; A61M 11/041; A61M 11/042; B05B 7/2491; B05B 7/24; B05B 7/241; B05B 7/2416; B05B 7/0012; F23D 7/00; F23D 11/10; F23D 11/448; F23D 11/46; B01F 3/04; B01F 3/04014
See application file for complete search history.

(56) References Cited

U.S. PATENT DOCUMENTS 3,090,420 A * 5/1963 Sacco ..... F23D 11/44 239/133
4,472,133 A * 9/1984 Petersen ..... F23D 11/448 431/121
5,372,754 A * 12/1994 Ono ..... B01F 3/022 118/726
2008/0305445 A1* 12/2008 Roberts ..... F23D 11/446 431/9

* cited by examiner

*Primary Examiner* — Justin C Dodson
(74) *Attorney, Agent, or Firm* — Ulysses John Biffoni

(57) ABSTRACT

A system and method for generating combustion aerosols from liquid fuel. The system includes a furnace with an inner heating tube having a heating tape wrapped thereabout. Further, the system includes a fuel line extending through an inlet end of the heating tube and into the heating tube, and a means for dripping the liquid fuel onto a plurality of different locations on an inner surface of the heating tube. The system further includes a power supply to power the heating tape to heat the inner heating tube to a temperature which can ignite the liquid fuel dripped onto the inner surface of the inner heating tube whereby there is an immediate combustion to form combustion products. Finally, the system includes an air line connected to the heating tube for directing compressed air through the inner heating tube to mix with the combustion products and transport the formed combustion aerosols out of an outlet end of the inner heating tube.

7 Claims, 4 Drawing Sheets

COMBUSTION AEROSOL GENERATOR SYSTEM

CROSS-REFERENCE TO RELATED APPLICATIONS

This application is a divisional of U.S. application Ser. No. 14/835,199 filed on Aug. 25, 2015, now U.S. Pat. No. 10,539,320 which is commonly assigned.

GOVERNMENT INTEREST CLAUSE

The invention described herein may be manufactured, used, and/or licensed by or for the United States Government.

TECHNICAL FIELD OF THE INVENTION

The present invention relates to a combustion aerosol generator system and more particularly to a system for generating combustion aerosols from liquid fuel.

BACKGROUND OF THE INVENTION

An aerosol is defined as an assembly of liquid or solid particles suspended in a gaseous medium. Aerosols are useful in a wide variety of applications. For example, it is often desirable to treat respiratory ailments with, or deliver drugs by means of, aerosol sprays of finely divided particles of liquid and/or solid, e.g., powder, medicaments, etc., which are inhaled into a patient's lungs. Aerosols are also used for purposes such as providing desired scents to rooms, applying scents on the skin, and delivering paint and lubricant. Aerosols have also been considered for fuel delivery systems for high performance engines and turbines where the small particle size influences ignition rates, combustion efficiencies and flame speed. Aerosol generation in areas of combustion initially result in the formation of vapor, but may after ignition result in smoke particles and vapor, due to the temperature experienced in the furnace.

Previously, combustion aerosols were generated for test purposes using actual vehicle exhaust transported through a long hose to test chambers. In some cases, small engines were located inside or outside a test chamber to generate the aerosols. There was very little control of the output when actual vehicles and engines were used. In addition, the particle size distribution and concentration changed during the transport of these aerosols through the long transport tube.

SUMMARY OF THE INVENTION

According to an embodiment of the present invention, there is disclosed a system for generating combustion aerosols from liquid fuel. The system includes a furnace with an inner heating tube having a heating tape wrapped there about. Further, the system includes a fuel line extending through the inlet end of the heating tube and into the heating tube for dripping the liquid fuel onto a plurality of locations on the inner surface. The system further includes a power supply to heat the heating tape and the inner heating tube to vaporize the liquid fuel dripped onto the inner surface of the inner heating tube whereby there is an immediate combustion to form combustion products. Finally, the system includes an air line connected to the heating tube for directing compressed air through the inner heating tube to mix with the combustion products and transport the formed combustion aerosols out of an outlet end of the inner heating tube.

According to another embodiment of the present invention, there is disclosed a furnace for generating combustion aerosols from liquid fuel. The furnace includes an inner heating tube having a heating tape wrapped there about. The furnace further includes a fuel line extending through the inlet end of the heating tube and into the heating tube for dripping the liquid fuel onto a plurality of locations on the inner surface. Further, the furnace includes a power supply to heat the heating tape and the inner heating tube to vaporize the liquid fuel dripped onto the inner surface of the inner heating tube whereby there is an immediate combustion to form combustion products. Finally, the furnace includes an air line connected to the heating tube for directing compressed air through the inner heating tube to mix with the combustion products and transport the formed combustion aerosols out of an outlet end of the inner heating tube.

According to another embodiment of the present invention, there is disclosed a method for generating combustion aerosols from liquid fuel. The method includes dripping the liquid fuel onto a plurality of locations on an inner surface of an inner heating tube. The method further includes vaporizing the liquid fuel dripped onto the inner surface of the inner heating tube whereby there is an immediate combustion to form combustion products. Further, the method includes directing compressed air through the inner heating tube to mix with the combustion products and forming combustion aerosols. Finally, the method includes transporting the combustion aerosols out of an outlet end of the inner heating tube.

According to another embodiment of the present invention, there is disclosed a furnace for generating a fog oil aerosols from fog oil. The furnace includes an inner heating tube having a heating tape wrapped there about. An oil line extends through the inlet end of the heating tube and into the heating tube for dripping the fog oil onto a plurality of locations on the inner surface of the inner heating tube. A power supply to heat the heating tape and the inner heating tube to vaporize the liquid fog oil dripped onto the inner surface of the inner heating tube. An air line connected to the heating tube directs compressed air through the inner heating tube to mix with the vaporized fog oil and transport the resulting fog oil aerosol out of an outlet end of the inner heating tube. The temperature is controlled so that the auto-ignition temperature is not reached in this case.

BRIEF DESCRIPTION OF THE DRAWINGS

The structure, operation, and advantages of the present invention will become further apparent upon consideration of the following description taken in conjunction with the accompanying figures (Figs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

DETAILED DESCRIPTION OF THE PREFERRED EMBODIMENTS

Figure 1:
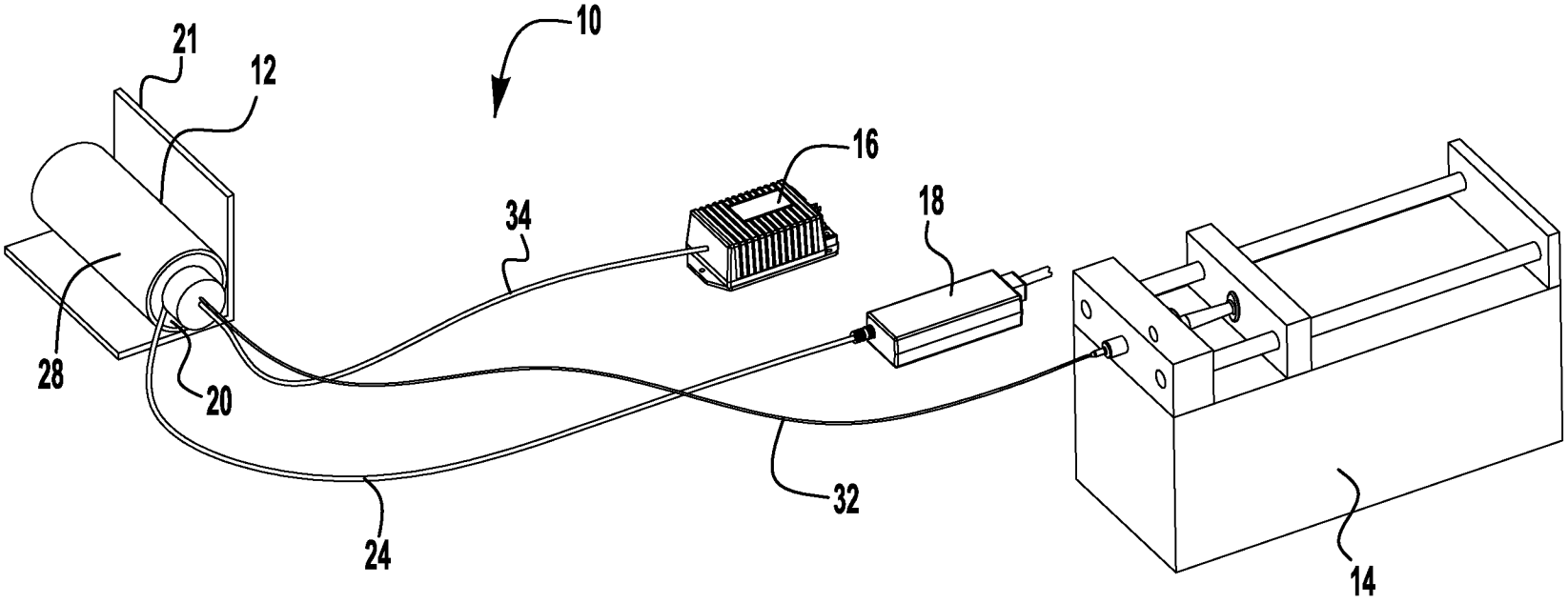
FIG. 1 is a front view of a combustion aerosol generator system, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

Figure 2:
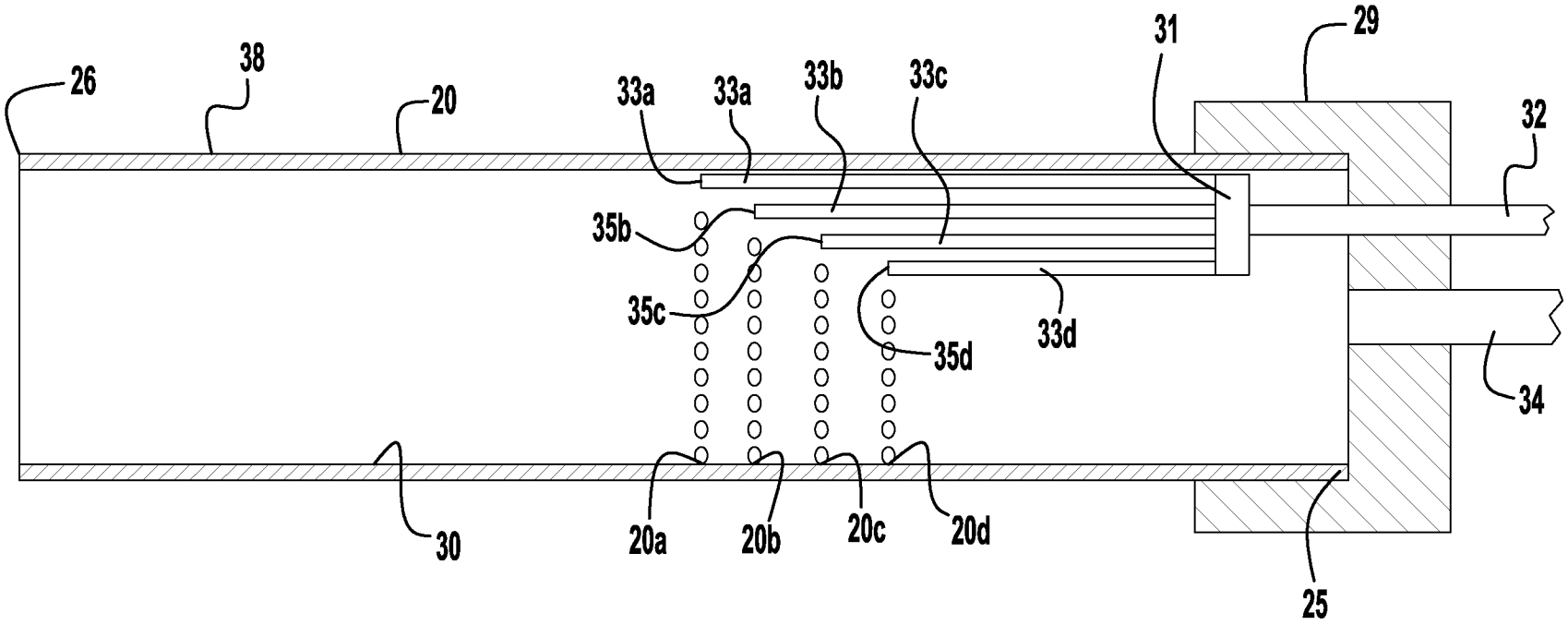
FIG. 2 is a cross-sectional view of the inner heating tube of the combustion aerosol generator system, in accordance with the present invention.

The combustion aerosol generator system 10, as shown in FIG. 1, consists of a furnace 12, syringe pump 14, air flow controller 16, and a power supply 18. In general terms, a liquid fuel such as gasoline or diesel fuel is introduced into a heating tube 20 through a line 32, as shown in FIG. 2, by a syringe pump 14. Ground solid material suspended in the liquid fuel can also be used, as explained regarding the liquid fuel to produce combustion products. Although throughout the specification, liquid fuel is discussed, it should be understood that ground solid material suspended in liquid may be used. In an additional embodiment, solid materials can be placed on the heated surface to produce combustion products. In a further embodiment, a gas such as methane or ethane can be delivered to the heated inner tube and directed towards the heated surface to produce combustion products.

The heating tube 20 is heated to a sufficient temperature to vaporize the gasoline or diesel fuel whereby there is an immediate combustion to form combustion products. Compressed air also is directed into the heating tube 20 through an air line 34 to mix with the combustion products, forming combustion aerosols and transporting the combustion aerosols out of the heating tube. The combustion aerosols can be utilized as desired in a laboratory setting.

The furnace 12 of the combustion aerosol generator system 10 consists of the inner heating tube 20 and an outer tube 28 separated by an insulation material so that the hot surface of the inner heating tube is not accessible to the operator. The furnace can be supported by any means such as an L-shaped support base 21.

Figure 3:
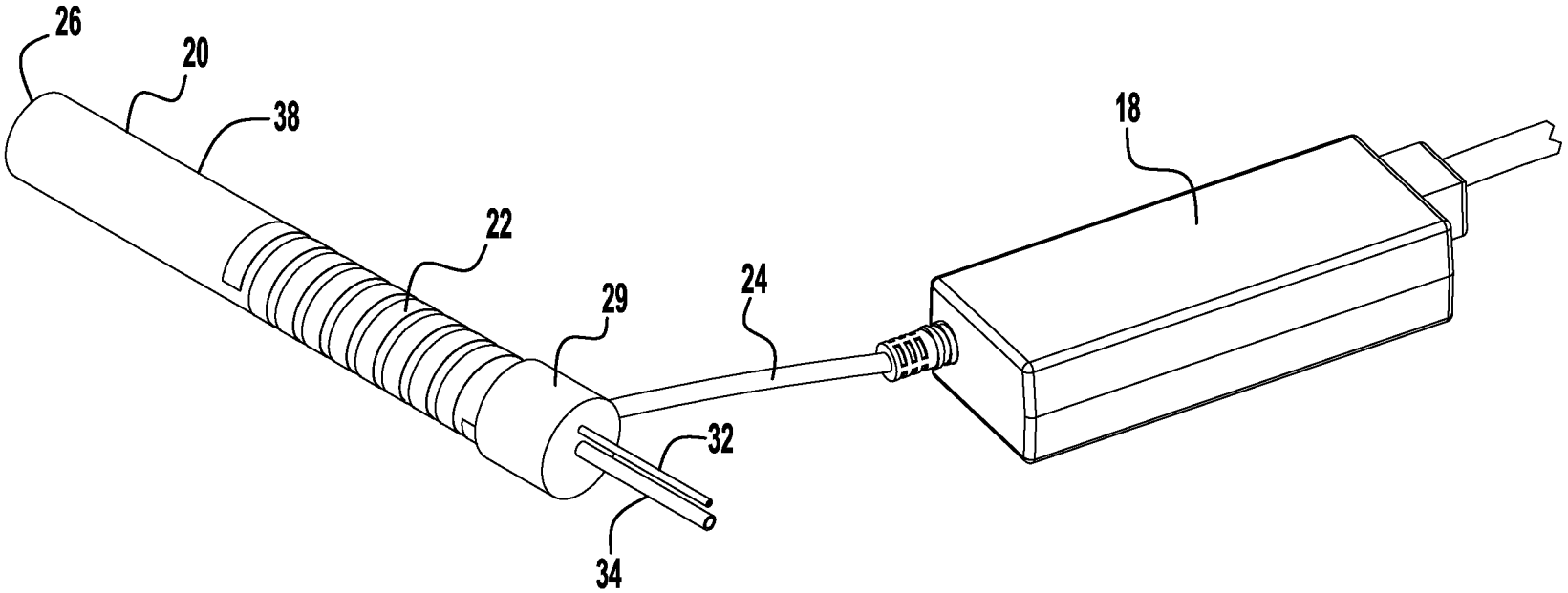
FIG. 3 is a three-dimensional view of the inner heating tube and power supply of the combustion aerosol generator system connected to heat tape wrapped around the inner heating tube, in accordance with the present invention.

As seen in FIGS. 2 and 3, the inner heating tube 20 is cylindrical in shape and has an end cap 29 closing an inlet opening at a first end 25 of the heating tube. It should be noted that the heating tube 20 can have a rectangular cross section so that the inner heating tube 20 may have a rectangular heated surface. A second end 26 of the heating tube 20 is open and forms an outlet opening of the inner heating tube. The heating tube 20 may be constructed of any desired material of high thermal conductivity such as aluminum, brass, and preferably copper. The inner heating tube 20 may be of any desired dimensions, such as a diameter of between about 1 and 2 inches and preferably about 1.5 inches and a length of between about 8 and 20 inches and preferably about 12 inches.

The combustion product aerosols are generated by dripping the liquid fuel onto a plurality of locations 20*a*, 20*b*, 20*c*, and 20*d* (20*a*-20*d*) of the inner surface 30 of the heating tube 20. The inner surface may be flat or alternatively may have a layer of beads formed on the inner surface 30 of the heating tube 20 to increase the surface area. Although four locations 20*a*-20*d* are illustrated, any desired amount of locations on the inner surface may be utilized. The fuel line 32 from the syringe pump 14 goes through the end cap 29 and connects to a liquid manifold 31. Four lines 33*a*, 33*b*, 33*c*, and 33*d* of different lengths extend outward from the liquid manifold 31 over locations 20*a*-20*d* on the inner surface 30 of the inner heating tube 20. Besides the fuel line 32 from the syringe pump 14, an air line 34 from the air flow controller 16 extends through the end cap 29.

As seen in FIG. 3, the inner surface 30 of inner heating tube 20 is heated by wrapping heating tape 22 around a portion or the entire length of the outer surface 38 of the heating tube 20. Any desired type of heating tape 22 may be utilized, such as for example 0.5 inch by 4 inch dual element heat tape, which is 312 watts. The temperature of the tube 20 is adjusted to be higher than the auto-ignition temperature for the combustion products of the liquid fuel dripping onto the plurality of locations 20*a*-20*d* on the inner surface 30 of the heating tube 20. A thermocouple can be disposed on the outer surface 38 of the heating tube 20 to measure the temperature of the outside surface of the inner heating tube and provide more accurate control of the temperature within the heating tube.

In an alternative embodiment, the liquid fuel may be replaced with a fog oil, which is used to create fog oil aerosols that are often used in a military setting. Using the combustion aerosol generator system 10, a fog oil is dripped onto a plurality of locations 20*a*, 20*b*, 20*c*, and 20*d* (20*a*-20*d*) of the inner surface 30 of the heating tube 20. The aerosols formed by the compressed air mixing with the vaporized liquid is not a combustion product, if the temperature of the inner tube 20 is set to be lower than the auto-ignition value of the liquid. This principle is used in generating fog oil aerosols from fog oil liquid where the temperature is set to be less than the auto-ignition value of the fog oil liquid.

To heat the tape 22, the heating tape 22 is connected to the power supply 18 via the connecting wire 24. Once the power supply 18 is activated, the heating tape 22 can heat the inner heating tube 20 to the desired temperature. It is within the terms of the embodiment that the power supply 18 be programmed to achieve various control schemes. For instance, a resistance control scheme can be used to minimize overheating and under heating of the heating tape 22. In particular, a program can be used to send power to the heating tape 22 until a target resistance value is reached. Under a power control scheme, a certain amount of power is supplied to the heating tape 22 and the power is monitored and adjusted to maintain the inner heating tube 20 at a desired temperature.

Figure 4:
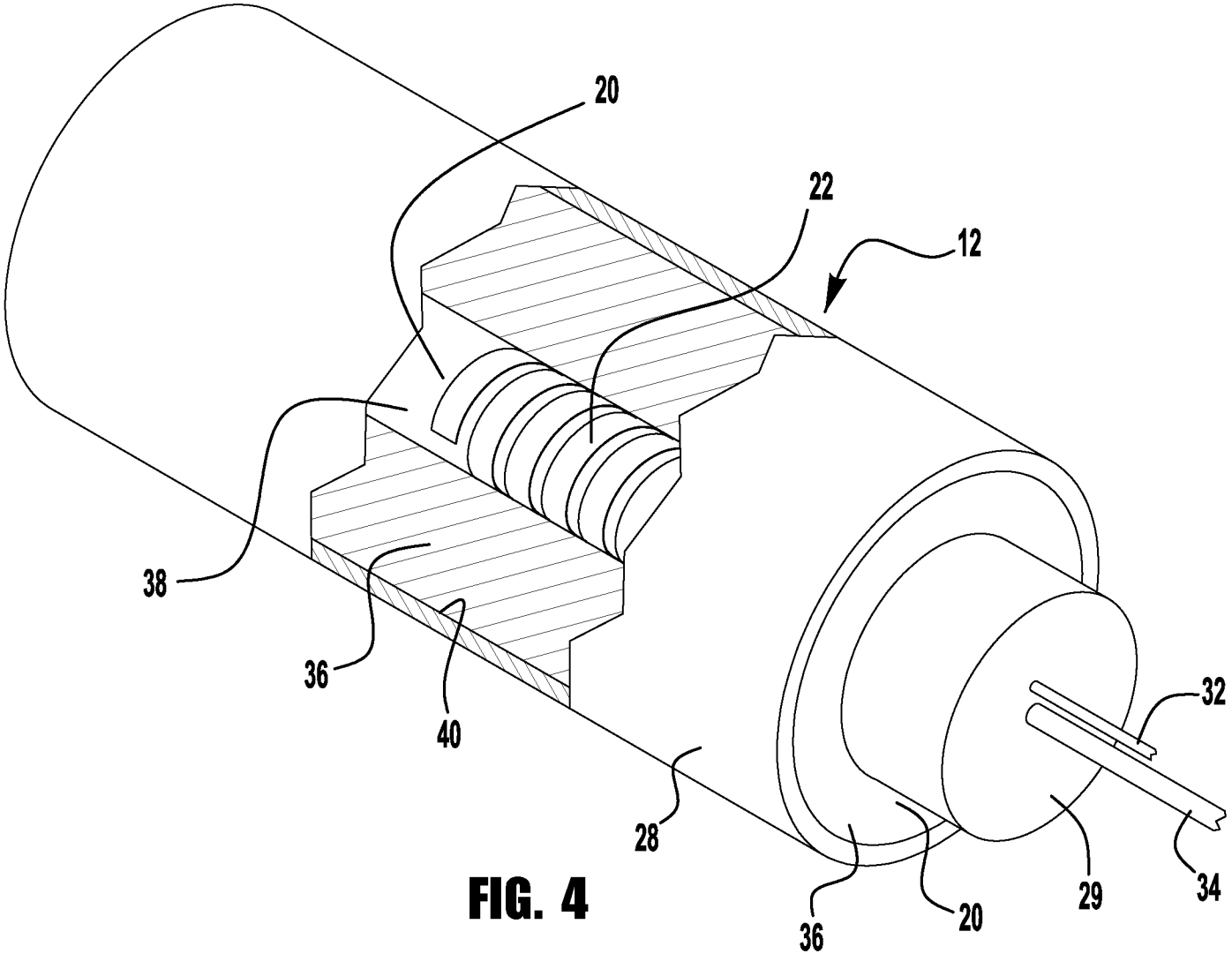
FIG. 4 is a three-dimensional, cut-away view of the furnace of the combustion aerosol generator system, in accordance with the present invention.

As seen in FIG. 4, the inner heating tube 20 wrapped with the heat tape 22 is covered with insulation 36 and placed in an outer tube 28. The outer tube 28, being insulated from inner heating tube 20 is designed to prevent heat exposure to the operators. The outer tube 28 may be constructed of any desired material, preferably metal, and may be of any desired dimensions, such as a diameter of between about 5 and 7 inches and preferably about 5 inches and a length of between about 8 and 20 inches and preferably about 12 inches. There are one or more layers of insulation 36 between the outer surface 38 of the heating tube 20, and the inner surface 40 of the outer tube 28. As illustrated, the one or more layers of insulation 36 can be layers of 1 inch ceramic fiber blanket insulation. It is also within the terms of the invention to surround the outer tube 28 with layers of insulation.

As seen in FIG. 1, the syringe pump 14 delivers the liquid fuel from the syringe pump 14 to the inner surface 30 of the inner heating tube 20 through the fuel line 32 for aerosol generation. An exemplary syringe pump 14 is the "New Era Pump Systems NE-300 Just Infusion Syringe Pump," which utilizes a keypad interface to set the syringe diameter, set the infusion rate and start the pump. In a preferred embodiment, the syringe pump 14 can be used to deliver liquid fuel to the inner heating tube 20 at a constant rate for a predetermined time. However, it is also within the terms of the embodiment that the syringe pump 14 be used to deliver liquid fuel to the inner heating tube 20 at a variable rate. Further, a programmed controller (not shown) can execute the instructions for operating the syringe pump 14 to deliver a desired amount of liquid fuel to the heating tube 20.

As discussed earlier, the liquid fuel enters into the inner heating tube 20 through fuel line 32 extending through the end cap 29. As seen in FIG. 2, the liquid fuel is dripped onto a plurality of locations 20*a*, 20*b*, 20*c*, and 20*d* (20*a*-20*d*) of the inner surface 30 of the heating tube 20. Although four locations 20*a*-20*d* are illustrated, any desired amount of locations may be utilized. A plurality of lines 33*a*, 33*b*, 33*c*, and 33*d* (33*a*-33*d*) of different lengths connect adjacent an inlet end 25 of the heating tube 20 to the liquid manifold 31. An outlet end 35*a*, 35*b*, 35*c* and 35*d* (35*a*-35*d*) of each of the plurality of lines 33*a*-33*d*, respectively, is disposed over one of the plurality of locations 20*a*-20*d* on the inner surface 30 of the inner heating tube 20. As seen in FIG. 2, the fuel line 32 separates into four separate lines 33*a*-33*d*, such that the liquid fuel drips through lines 33*a*-33*d* onto locations 20*a*-20*d*, respectively. As the liquid fuel drips onto the inner surface 30 that has been heated by the heating tape 22, the liquid fuel is vaporized and combustion products are generated.

The airflow controller 16 directs compressed air through airline 34 which extends through the end cap 29 to the interior of the inner heating tube 20. The compressed air mixes with the combustion products that were generated and transports the resulting combustion product aerosols out of the open second end 26 of the inner heating tube 20 within furnace 12. As mentioned earlier, the compressed air flows from the airflow controller 16 through the air line 34 and into the inner heating tube 20. It is within the terms of the preferred embodiment that a rotameter is utilized to control the flow of compressed air from the airflow controller 16, such as the King Instrument 7510 Rotameter. The combustion product aerosols will be delivered to a desired location, typically in a laboratory setting.

In use, the combustion aerosol generator system 10 is operated by first initiating the power supply 18. The power supply 18 is connected via connecting wires 24 to the heating tape 22 surrounding the inner heating tube 20. The power supply 18 may be programmed to achieve various control schemes of the heating tape 22. Once the heating tape 22 has elevated the temperature of the heating tube 20 to a desired temperature, the syringe pump 14 delivers the liquid fuel from the syringe pump 14 to the inner surface 30 of the inner heating tube 20 through the fuel line 32 for aerosol generation. The liquid fuel is dripped onto a plurality of locations 20*a*, 20*b*, 20*c*, and 20*d* (20*a*-20*d*) of the inner surface 30 of the heating tube 20. The heated inner surface vaporizes the liquid fuel whereby there is an immediate combustion to form combustion products. Then, the compressed air flowing from the air flow controller 16 through the air line 34 and into the inner heating tube 20 mixes with the combustion products to form combustion product aerosols. The combustion product aerosols are transported by the air out of the open second end 26 of the inner heating tube 20 and are delivered to a desired location, typically in a laboratory setting.

The combustion aerosol generator system 10 has the benefit of controllable particle size distribution and concentration, while remaining flameless and without the need for actual vehicle exhaust. Particle size and concentration are varied by adjusting the liquid fuel feed rate from the syringe pump 14, air flow rate from the air flow controller 16, and temperature of the heating tape 22.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. A method for generating combustion aerosols from liquid fuel, comprising:

supplying liquid fuel through a fuel line into a furnace, wherein said furnace includes an inner heating tube having an inlet end and an outlet end, and a means for heating said inner heating tube; and said fuel line extends through the inlet end and into the inner heating tube, wherein said fuel line connects to a liquid fuel manifold and wherein said manifold includes a plurality of lines of different lengths so that an outlet end of each of the plurality of lines is disposed over a different location on an inner surface of the inner heating tube, so that the liquid fuel from the fuel line passes into the manifold and then through said plurality of lines and is dripped from the outlet end of each of the plurality of lines onto a plurality of different locations on the inner surface of the inner heating tube; and wherein said means for heating is configured so that the inner surface of the inner heating tube is maintained at a temperature which exceeds the auto-ignition temperature of the liquid fuel so that there is an immediate combustion to form combustion products; and directing air through an air line connected to the inlet end of the inner heating tube so that air flows through the inner heating tube to mix with the combustion products and transports the resulting combustion product aerosols out of the outlet end of the inner heating tube.

2. The method of claim 1, wherein the inner heating tube is cylindrical in shape and constructed of a material of high thermal conductivity.

3. The method of claim 1, wherein the inner heating tube has an end cap closing the inlet end of the inner heating tube, and wherein the fuel line and the air line extend through the end cap.

4. The method of claim 1, wherein said means for heating said inner heating tube comprises heating tape wrapped around a portion of an outer surface of the inner heating tube, and a power supply to provide power to said heating tape.

5. The method of claim 1, further including a syringe pump for delivering the liquid fuel into the fuel line.

6. The method of claim 1, wherein the furnace includes:

an outer tube having the inner heating tube disposed therein; and a layer of insulation material disposed between the inner heating tube and the outer tube.

7. The method of claim 1, wherein an airflow controller directs said air into the inner heating tube through said air line.

* * * * *